US010997813B2

(12) United States Patent
Zhang et al.

(10) Patent No.: US 10,997,813 B2
(45) Date of Patent: May 4, 2021

(54) VENDING MACHINE

(71) Applicant: Shandong New Beiyang Information Technology Co., Ltd., Shandong (CN)

(72) Inventors: Jigang Zhang, Shandong (CN); Jialing Sun, Shandong (CN); Kai Liu, Shandong (CN); Hongze Wei, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 0 days.

(21) Appl. No.: 16/466,948

(22) PCT Filed: Oct. 24, 2017

(86) PCT No.: PCT/CN2017/107521
§ 371 (c)(1),
(2) Date: Jun. 5, 2019

(87) PCT Pub. No.: WO2018/103465
PCT Pub. Date: Jun. 14, 2018

(65) Prior Publication Data

US 2020/0066085 A1 Feb. 27, 2020

(30) Foreign Application Priority Data

Dec. 8, 2016 (CN) ..... 201611120379.5

(51) Int. Cl.
*G07F 11/54* (2006.01)
*G07F 11/72* (2006.01)
*G07F 17/12* (2006.01)

(52) U.S. Cl.
CPC ..... *G07F 11/54* (2013.01); *G07F 11/72* (2013.01); *G07F 17/12* (2013.01)

(58) Field of Classification Search
CPC ..... G07F 11/54; G07F 11/72; G07F 17/12; G07F 11/16; G07F 11/22; G07F 11/50; B65H 3/00
(Continued)

(56) References Cited

U.S. PATENT DOCUMENTS 3,409,171 A * 11/1968 Elmer ..... A47F 1/10 221/90
3,757,992 A * 9/1973 Cruickshank ..... B65H 67/067 221/13
(Continued)

FOREIGN PATENT DOCUMENTS

CN 101110142 A 1/2008
CN 203299928 U 11/2013
CN 106193888 A 12/2016

OTHER PUBLICATIONS

International Search Report dated Jan. 30, 2018, in the International Application: PCT/CN2017/107521—with English Translation (4 pages).

*Primary Examiner* — Rakesh Kumar
(74) *Attorney, Agent, or Firm* — Wilmer Cutler Pickering Hale and Dorr LLP

(57) ABSTRACT

A vending machine comprises a cabinet, a rotating mechanism and a linkage mechanism. The cabinet comprises a cabinet body and a cabinet door pivotally connected to the cabinet body. An accommodating space is arranged in the cabinet body. An opening communicated with the accommodating space is arranged on the cabinet body. The cabinet door is capable of opening or closing the opening. The rotating mechanism is arranged in the cabinet body and is rotatable relative to the cabinet body. The cabinet door drives the rotating mechanism to rotate via the linkage
(Continued)

mechanism, when the cabinet door is rotated toward a set position from a closed position.

15 Claims, 10 Drawing Sheets

(58) Field of Classification Search
USPC ..... 221/113
See application file for complete search history.

(56) References Cited

U.S. PATENT DOCUMENTS

| | | | | | |
|---|---|---|---|---|---|
| 4,498,603 | A * | 2/1985 | Wittenborg | G07F 11/54 | 221/120 |
| RE32,191 | E * | 6/1986 | Krakauer | G07F 11/54 | 221/113 |
| 5,242,080 | A * | 9/1993 | Kroon | B65B 7/2807 | 221/113 |
| 5,313,393 | A * | 5/1994 | Varley | G06Q 10/087 | 194/205 |
| 5,730,316 | A * | 3/1998 | Falk | G07F 11/007 | 221/12 |
| 6,427,865 | B1 * | 8/2002 | Stillwell | G07F 11/54 | 221/113 |
| 7,182,219 | B2 * | 2/2007 | Chang | G07F 11/10 | 221/122 |
| 8,469,228 | B2 * | 6/2013 | Adams | G07F 7/0609 | 221/120 |
| 2004/0245278 | A1 * | 12/2004 | Steffens | G07F 7/0609 | 221/265 |
| 2006/0102646 | A1 * | 5/2006 | Godlewski | G07F 11/54 | 221/76 |
| 2020/0066085 | A1 * | 2/2020 | Zhang | G07F 11/54 | |

* cited by examiner

VENDING MACHINE

RELATED APPLICATIONS

This application is a United States national phase application of co-pending international patent application number PCT/CN2017/107521, filed on Oct. 24, 2017, which claims priority to Chinese patent application No. 201611120379.5 filed on Dec. 8, 2016, disclosures of both of which are incorporated herein by reference in their entireties.

TECHNICAL FIELD

The present disclosure relates to the technical field of vending apparatus, for example, a vending machine.

BACKGROUND

A vending machine is one kind of machine that can automatically deliver commodity according to the input money, and common equipment for commercial automation. The vending machine has the characteristics of being free from time and place, saving manpower and facilitating transactions, and thus has a broad market at home and abroad.

The related art provides a vending machine, including a cabinet and a plurality of cargo compartments arranged in the cabinet. The plurality of cargo compartments are arranged in three columns and eight rows. Each of the cargo compartments is provided with a door, and comprises a turntable arranged on the bottom of the cargo compartment, a rotary shaft perpendicularly connected with the turntable, and a motor which is arranged under the turntable and connected with the rotary shaft in a transmission manner. The rotary shaft is symmetrically provided with six partition boards to divide each of the cargo compartments into six commodity storage spaces. One commodity is placed in each of the commodity storage space. Each time after one commodity is sold, the motor drives the rotary shaft to rotate 60 degrees, and the turntable rotates along with the rotary shaft, so that the commodity in next one of the commodity storage spaces faces to the door.

Since this kind of vending machine uses a plurality of motors and the cost of motor is relatively high, it results in a high manufacturing cost of the machine.

SUMMARY

A vending machine is provided by the present disclosure, to solve a technical problem of high cost of the vending machine in the related art caused by adopting motor to drive the rotating mechanism.

A vending machine provided by the present embodiment comprises a cabinet, a rotating mechanism and a linkage mechanism.

The cabinet comprises a cabinet body and a cabinet door pivotally connected to the cabinet body. An accommodating space is arranged in the cabinet body. An opening communicated with the accommodating space is arranged on the cabinet body. The cabinet door is capable of opening or closing the opening.

The rotating mechanism is arranged in the cabinet body, and is rotatable relative to the cabinet body.

The cabinet door is configured to drive the rotating mechanism to rotate via the linkage mechanism when the cabinet door is rotated toward a set position from a closed position.

Optionally, the linkage mechanism comprises a driving member and a first locking mechanism.

The driving member is connected with the cabinet door in a transmission manner. The first locking mechanism is arranged on the driving member, and has a locked state and a released state.

The rotating mechanism is configured to synchronously rotate with the driving member when the first locking mechanism is in the locked state.

The driving member is unable to drive the rotating mechanism to rotate when the first locking mechanism is in the released state.

Optionally, when the cabinet door is rotated toward the set position from the closed position, the first locking mechanism is in the locked state, and the driving member is configured to drive, by rotating the cabinet door, the rotating mechanism to rotate along a first direction.

When the cabinet door is rotated toward the closed position from the set position, the first locking mechanism is in the released state, and the driving member is configured to rotate, driven by the cabinet door, relative to rotating mechanism along a second direction.

The second direction is opposite to the first direction.

Optionally, the driving member is fitly sleeved on a rotary shaft of the rotating mechanism.

The linkage mechanism further comprises a connecting rod. A first end of connecting rod is pivotally connected to the cabinet door, and a second end of the connecting rod is pivotally connected to the driving member. A linking mechanism is formed between the cabinet door, the connecting rod, the driving member and the rotary shaft.

Optionally, the linking mechanism is a crank and rocker mechanism.

The cabinet door is pivotally connected to the cabinet body via a pivoting shaft. The connecting rod is pivotally connected to the driving member via a first pivot, and pivotally connected to the cabinet door via a second pivot. A crank is formed between the pivoting shaft and the second pivot. A rocker is formed between the rotary shaft and the first pivot.

Optionally, the rotating mechanism comprises a rotary shaft, a rotating plate body and an index plate; the rotating plate body and the index plate are fixedly sleeved on the rotary shaft in sequence. A plurality of index holes are distributed at intervals on the index plate along a circumferential direction of the rotary shaft.

The first locking mechanism comprises a first pin movably connected with the driving member and capable of being inserted into any one of the index holes, and a first elastic member connected between the driving member and the first pin. Under an action of the first elastic member, the first pin always has a tendency to be inserted into the index hole.

When the cabinet door is rotated toward the set position from the closed position, the first pin is inserted into the index hole, and the first locking mechanism is in the locked state.

When the cabinet door is rotated toward the closed position from the set position, the first pin is detached from the index hole, and the first locking mechanism is in the released state.

Optionally, the index plate comprises a bottom plate and a cylinder wall. The bottom plate is sleeved on the rotary shaft. The cylinder wall is arranged along a circumference of the bottom plate. An inner annular groove is arranged on an inner side of the cylinder wall. The index holes are located in the inner annular groove and penetrate through the cylinder wall;

The first pin is configured to move along the inner annular groove when the cabinet door is rotated toward the closed position from the set position.

Optionally, the linkage mechanism further comprises a second locking mechanism arranged on the cabinet body and possessing a locked state and a released state.

The rotating mechanism is fixed relative to the cabinet body when the second locking mechanism is in the locked state.

The rotating mechanism is rotatable relative to the cabinet body when the second locking mechanism is in the released state.

Optionally, the rotating mechanism comprises a rotary shaft, a rotating plate body and an index plate; the rotating plate body and the index plate are fixedly sleeved on the rotary shaft in sequence. A plurality of index holes are distributed at intervals on the index plate along a circumferential direction of the rotary shaft.

The second locking mechanism comprises a second pin movably connected with the driving member and capable of being inserted into any one of the index holes, a second elastic member connected between the cabinet body and the second pin, and a second pillar connected with the second pin. Under an action of the second elastic member, the second always pin has a tendency to be inserted into the index hole; the driving member is provided with an abutment portion.

When the cabinet door is rotated toward the set position from the closed position, the abutment portion is directly or indirectly abutted against the second pillar to drive the second pin to be detached from the index hole, so that the second locking mechanism is in the released state.

Optionally, the first locking mechanism comprises a first pin movably connected with the driving member and capable of being inserted into any one of the index holes, and a first elastic member connected between the driving member and the first pin. Under the action of the first elastic member, the first pin always has a tendency to be inserted into the index hole.

When the cabinet door is rotated toward the set position from the closed position, the first pin is inserted into the index hole, and the first locking mechanism is in the locked state.

When the cabinet door arrives at the set position, the index hole into which the first pin is inserted faces to the second pin, the second pin is inserted into the index hole, and pushes the first pin out of the index hole.

When the cabinet door is rotated toward the closed position from the set position, the first pin is detached from the index hole, the second pin is inserted into the index hole, the first locking mechanism is in the released state, and the second locking mechanism is in the locked state.

Optionally, the index plate comprises a bottom plate and a cylinder wall. The bottom plate is sleeved on the rotary shaft. The cylinder wall is arranged along a circumference of the bottom plate. An outer annular groove is arranged on an outer side of the cylinder wall. The index holes are located in the outer annular groove and penetrate through the cylinder wall.

The second pin is configured to move along the outer annular groove when the cabinet door is rotated toward the set position from the closed position.

Optionally, the second locking mechanism further comprises a roller sleeved on the second pillar.

The abutment portion is abutted against the roller when the cabinet door is rotated toward the set position from the closed position.

Optionally, the vending machine further comprises an emergency mechanism. The emergency mechanism comprises a wrench pivotally connected to the rotary shaft.

When the wrench is driven to rotate about the rotary shaft along a set direction, the wrench causes the first locking mechanism and the second locking mechanism be simultaneously in the released state, so that the rotating mechanism, the driving member and the cabinet body are relatively rotatable.

Optionally, the first locking mechanism further comprises a first pillar connected with the first pin. The wrench comprises a driving groove into which the first pillar is inserted, and a driving portion abutted against the second pillar.

When the wrench is driven to rotate about the rotary shaft along the set direction, the driving groove drives, via the first pillar, the first pin to be detached from the index hole, and the driving portion drives, via the second pillar, the second pin to be detached from the index hole, so that the first locking mechanism and the second locking mechanism are simultaneously in the released state.

Optionally, the driving groove comprises a base side, a first side and a second side which are sequentially arranged from inside to outside along a radial direction of the rotary shaft. The first side and the second side are both arranged to be spaced from and be opposite to the base side. A first groove is formed between the first side and the base side. A second groove is formed between the second side and the base side.

The first pin is inserted into the index hole when the first pillar moves toward the second groove from the first groove.

The first pin is detached from the index hole when the first pillar moves toward the first groove from the second groove.

Optionally, the emergency mechanism further comprises a connecting member connected with cabinet body and moveable relative to the cabinet body. The rotating mechanism comprises a first rotating mechanism and a second rotating mechanism. The wrench comprises a first wrench and a second wrench. The first rotating mechanism is arranged to be corresponding to the first wrench. The second rotating mechanism is arranged to be corresponding to the second wrench. The connecting member is connected between the first wrench and the second wrench.

The connecting member comprises a first guiding groove and a second guiding groove. The driving portion of the first wrench is inserted into the first guiding groove. The driving portion of the second wrench is inserted into the second guiding groove. When the connecting member moves relative to the cabinet body, the connecting member drives, via the first guiding groove, the first wrench to rotate about the rotary shaft along a first set direction, and the connecting member drives, via the second guiding groove, the second wrench to rotate about the rotary shaft along a second set direction. The vending machine provided by the present embodiment greatly saves the manufacturing cost of the machine compared with the vending machine in the related art in which the motor drives the turntable to rotate.

Figure 1:
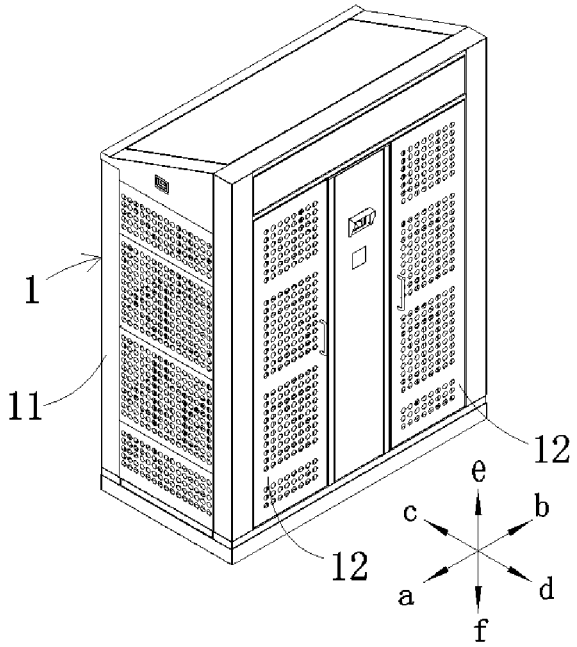
FIG. 1 is a structural schematic view of a vending machine when a cabinet door is in a closed position according to one embodiment.

In the drawings: 1—cabinet; 2—rotating mechanism; 3—linkage mechanism; 4—index plate; 5—driving member; 6—connecting rod; 7—first locking mechanism; 8—second locking mechanism; 9—emergency mechanism; 11—cabinet body; 12—cabinet door; 13—pivoting shaft; 21—rotary shaft; 22—rotating plate body; 23—partition plate; 41—bottom plate; 42—cylinder wall; 43—index hole; 51—first end of driving member; 52—second end of driving member; 56—first pivot; 61—first end of connecting rod; 62—second end of connecting rod; 612—second pivot; 71—first bracket; 72—first pin; 73—first elastic member; 74—first pillar; 81—second bracket; 82—second pin; 83—second elastic member; 84—second pillar; 85—roller; 91—first wrench; 92—second wrench; 93—connecting member; 111—first opening; 112—second opening; 113—upper wall; 114—rivet; 121—door body; 122—connecting board; 221—first turntable; 222—second turntable; 223—third turntable; 224—forth turntable; 421—inner annular groove; 422—outer annular groove; 431—first index hole; 432—second index hole; 711—first supporting board; 712—first supporting hole; 811—second supporting board; 812—second supporting hole; 911—driving groove; 912—driving portion; 931—long groove; 932—guiding groove.

DETAILED DESCRIPTION

In the description of the present disclosure, it is necessary to note that orientation or position relationships indicated by terms such as 'central', 'up', 'down', 'left', 'right', 'vertical', 'horizontal', 'interior' and 'exterior' are orientation or position relationships shown on the basis of the drawings, are only used for conveniently describing the present disclosure and simplifying description without indicating or suggesting that appointed devices or elements must have specific orientations or be constructed and operated at the specific orientations, therefore, the terms cannot be understood to limit the present disclosure. Moreover, the terms 'first' and 'second' are only used for descriptive purposes and cannot be understood to suggest or indicated relative importance, in which the terms 'first position' and 'second position' are two different positions.

In the description of the present disclosure, it is necessary to note that except for additional definite provision and restriction, terms such as 'mounting', 'connection' and 'connecting' should be generally understood, for example 'connection' may be fixed connection, detachable connection or integrated connection; 'connection' may be mechanical connection or electric connection; and 'connection' may be direct connection or indirect connection via an intermediate medium. For those of ordinary skill in the art, the specific meanings or the above-mentioned terms in the present disclosure can be understood according to particular cases.

Figure 2:
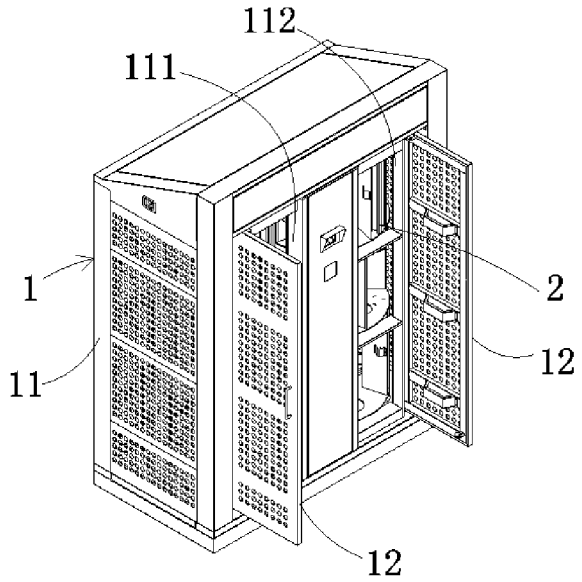
FIG. 2 is a structural schematic view of the vending machine when a cabinet door is in an opened position according to one embodiment.
Figure 3:
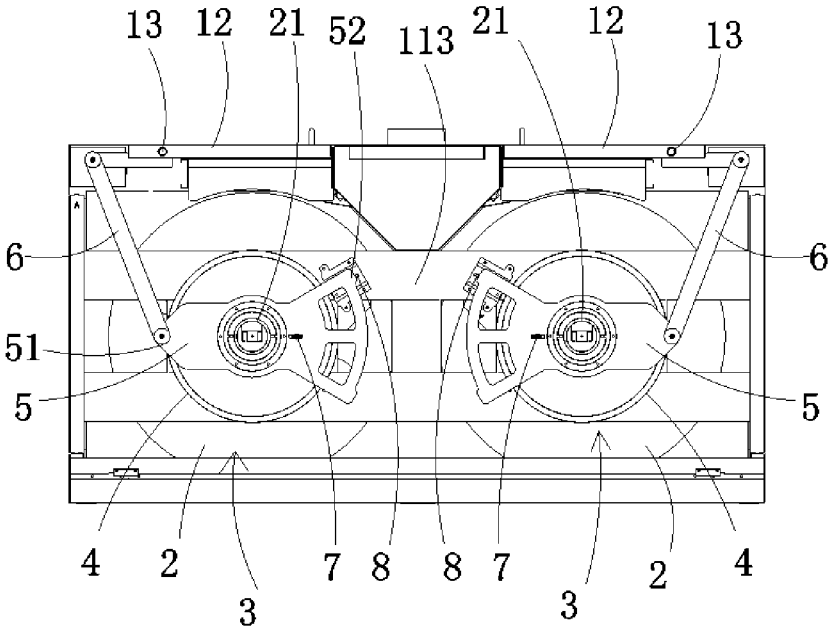
FIG. 3 is a partial structural top view of the vending machine according to one embodiment.
Figure 4:
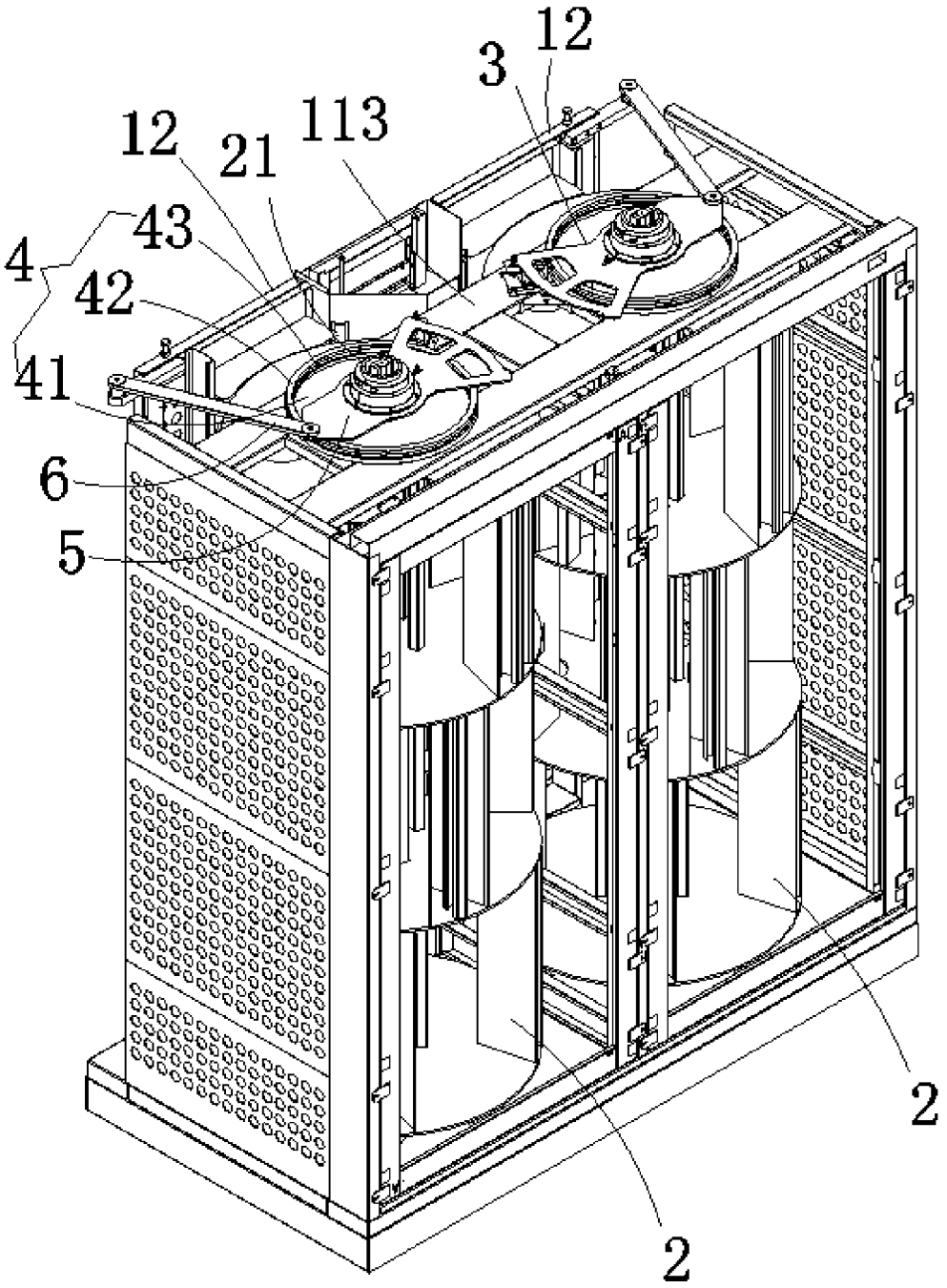
FIG. 4 is a partial structural schematic view of the vending machine according to one embodiment.

In the present disclosure, except for specific restriction, the term 'left-right direction' refers to the direction indicated by the arrow ab in FIG. 1. The term 'front-back direction' refers to the direction indicated by the arrow cd in FIG. 1. The term 'up-down direction' refers to the direction indicated by the arrow of in FIG. 1. And other directions are all based on the above directions. FIG. 1 is a structural schematic view of a vending machine when a cabinet door is in a closed position according to one embodiment. FIG. 2 is a structural schematic view of the vending machine when a cabinet door is in an opened position according to one embodiment. FIG. 3 is a partial structural top view of the vending machine according to one embodiment. FIG. 4 is a partial structural schematic view of the vending machine according to one embodiment.

As shown in FIG. 1 to FIG. 4, a vending machine provided by the present embodiment includes a cabinet 1, a rotating mechanism 2, and a linkage mechanism 3. The cabinet 1 includes a cabinet body 11 and a cabinet door 12. The cabinet body 11 may be a rectangle parallelepiped structure. An accommodating space is arranged inside the cabinet body 11. An opening communicated with the accommodating space is arranged on a surface of the cabinet body 11. The cabinet door 12 is pivotally connected to the cabinet body 11 via a pivoting shaft 13, and rotates about the pivoting shaft 13 to close or open the opening of the cabinet body 11. An axis of the pivoting shaft 13 extends along the up-down direction. When the opening of the cabinet body 11 is closed by the cabinet door 12, the cabinet door 12 is in a closed position. When the opening of the cabinet body 11 is opened by the cabinet door 12, the cabinet door 12 is in an opening position.

In the present embodiment, the cabinet 1 includes two cabinet doors 12. A first accommodating space and a second accommodating space are arranged inside the cabinet 11 along the left-right direction. A first opening 111 and a second opening 112 are arranged on the surface of the cabinet 11. The first opening 111 is communicated with the first accommodating space, while the second opening 112 is communicated with the second accommodating space. The two cabinet doors 12 are arranged in an oppositely-opened manner. One of the cabinet doors 12 is rotatable relative to the cabinet body 11 to close or open the first opening 111, another of the cabinet doors is rotatable relative to the cabinet body 11 to close or open the second opening 112.

The rotating mechanism 2 is rotatably mounted inside the accommodating space of the cabinet body 11. The rotational axis of the rotating mechanism 2 is arranged in parallel with the pivoting shaft 13. That is, a rotary shaft 21 of the rotating mechanism 2 is arranged in parallel with the pivoting shaft 13.

Figure 5:
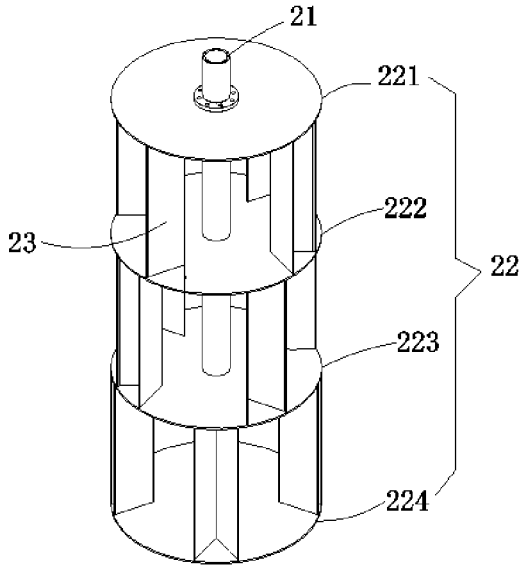
FIG. 5 is a structural schematic view of a rotating mechanism of the vending machine according to one embodiment.
Figure 6:
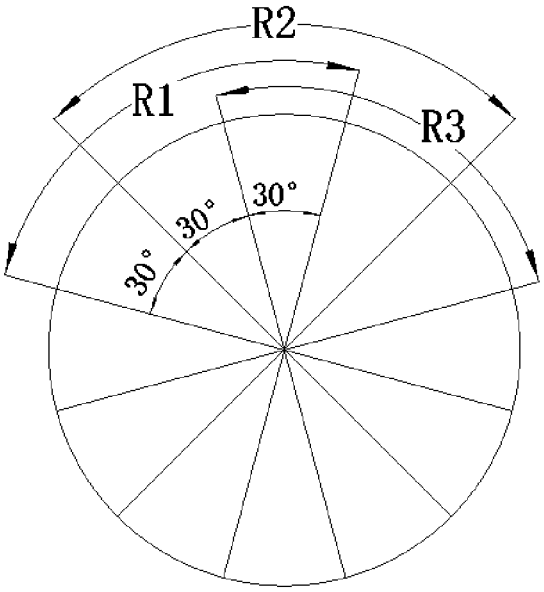
FIG. 6 is a distributional schematic view of a commodity storage space of the rotating mechanism of the vending machine according to one embodiment.

FIG. 5 is a structural schematic view of the rotating mechanism of the vending machine according to one embodiment. FIG. 6 is a distributional schematic view of a commodity storage space of the rotating mechanism of the vending machine according to one embodiment.

As shown in FIG. 4 and FIG. 5, the rotating mechanism 2 includes the rotary shaft 21, a rotating plate body 22 and an index plate 4. The rotating plate body 22 and the index plate 4 are fixedly sleeved on the rotary shaft 21 that extends along a direction in parallel with the pivoting shaft 13. An upper end of the rotary shaft 21 is fitly inserted into a top wall 113 of the cabinet body 11, a bottom end of the rotary shaft 21 is fitly inserted into a bottom plate (not shown in the drawings) of the cabinet body 11. The rotary shaft 21 can freely rotates about an axis of the rotary shaft 21. The index plate 4 is fixedly sleeved on the rotary shaft 21. When the rotary shaft 21 rotates about the axis of the rotary shaft 21, the index plate 4 rotates synchronously with the rotary shaft 21. The rotating plate body 22 includes a plurality of turntables. The plurality of turntables are fixedly sleeved on the rotary shaft 21, and distributed at intervals along an axial direction of the rotary shaft 21. One layer of accommodating portion for accommodating the commodity is formed between adjacent two of the turntables. When the rotary shaft 21 rotates around the axis of the rotary shaft 21, the plurality of the turntables rotates synchronously with the rotary shaft 21. A plurality of partition plates 23 are arranged in each layer of accommodating portion. The plurality of partition plates 23 are connected between respective two of the turntables vertically adjacent to each other, and evenly distributed at intervals along the rotating direction of the rotating mechanism 2. A plurality of commodity storage spaces are formed in each layer of accommodating portion. The commodity storage spaces in adjacent two layers of the accommodating portions are staggered by an index angle β along the rotating direction of the rotating mechanism 2. The index angle β=360 degrees/the total number of the commodity storage spaces. Optionally, as shown in FIG. 6, the commodity storage space R1 in a first layer of accommodating portion and the commodity storage space R2 in a second layer of accommodating portion are staggered by the index angle β. The commodity storage space R2 in the second layer of accommodating portion and the commodity storage space R3 in a third layer of accommodating portion are staggered by the index angle β. Each time the rotating mechanism 2 is rotated by one index angle β, only one of the commodity storage spaces completely faces to the opening of the cabinet body 11, so that the commodity in the one of the commodity storage spaces can be taken from the opening.

As shown in FIG. 5 and FIG. 6, in the present embodiment, the vending machine includes two rotating mechanisms 2, which are respectively mounted in the first accommodating space and the second accommodating space. The rotating plate body 22 includes a first turntable 221, a second turntable 222, a third turntable 223 and a forth turntable 224. The four turntables are arranged at intervals from top to bottom in sequence to form the first layer of accommodating portion, the second layer of accommodating portion and the third layer of accommodating portion. Four partition plates 23 are uniformly distributed at intervals in each layer of accommodating portion along the rotating direction of the rotating mechanism 2. The four partition plates form four commodity storage spaces, three layers of accommodating portions form twelve commodity storage spaces in total; index angle β=360°/12=30°. Therefore, the commodity storage space R2 in the second layer of accommodating portion and the commodity storage space R1 in the first layer of accommodating portion are staggered by 30 degrees. The commodity storage space R3 in the third layer of accommodating portion and the commodity storage space R2 in the second layer of accommodating portion are staggered by 30 degrees. Each time the rotating mechanism 2 is rotated by 30 degrees, only one of the twelve commodity storage spaces in the three layers of accommodating portions completely faces to the opening of the cabinet body 11, so that the commodity in the one of the twelve commodity storage spaces can be taken away or the commodity can be placed in the one of the twelve commodity storage spaces.

Figure 7:
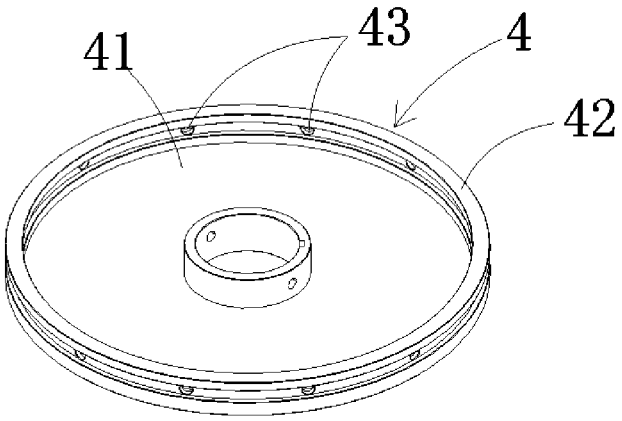
FIG. 7 is a structural schematic view of an index plate of the vending machine according to one embodiment.
Figure 8:
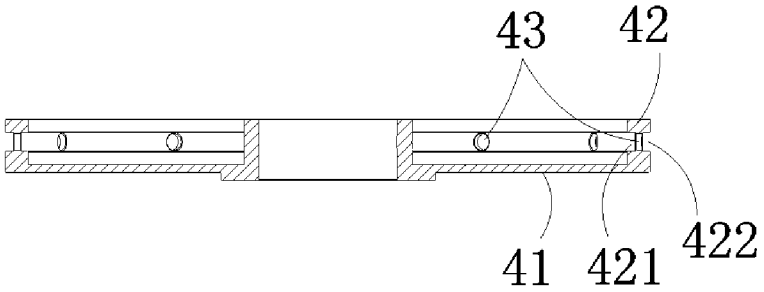
FIG. 8 is a structural sectional view of the index plate of the vending machine according to one embodiment.

FIG. 7 is a structural schematic view of the index plate of the vending machine according to one embodiment. FIG. 8 is a structural sectional view of the index plate of the vending machine according to one embodiment.

As shown in FIG. 7 and FIG. 8, the index plate 4 is a cylinder structure, including a bottom plate 41, a cylinder wall 42 and a plurality of index holes 43. A central hole of the bottom plate 41 is fixedly sleeved on the rotary shaft 21. The cylinder wall 42 extends along a direction perpendicular to a surface of the bottom plate 41, and is arranged along the outer circumference of the bottom plate 41. The plurality of index holes 43 are uniformly distributed on the cylinder wall 42 along the circumferential direction of the cylinder structure, and penetrate through the cylinder wall 42. Axes of the plurality of index holes 43 are all perpendicularly intersected with the axis of the rotary shaft 21 at one point. The number of index holes 43 is equal to the total number of the commodity storage spaces of the rotating mechanism 2. An angle between the axes of adjacent two of the index holes 43 is the index angle (3. Optionally, the index plate 4 includes twelve index holes 43.

Optionally, an inner side of the cylinder wall 42 is provided with an inner annular groove 421. An outer side of the cylinder wall 42 is provided with an outer annular groove 422. The outer annular groove 422 and the inner annular groove 421 are arranged at relative intervals. The groove widths of the inner annular groove 421 and the outer annular groove 422 are fitted with the diameter of each of the index holes 43. The index holes 43 are configured along the inner annular groove 421, and penetrate the inner annular groove 421 and the outer annular groove 422.

The linkage mechanism 3 is arranged between the cabinet door 12 and the rotating mechanism 2, and respectively connected with the cabinet door 12 and the rotating mechanism 2. The linkage mechanism 3 may be arranged on the top end or the bottom end of the rotating mechanism 2, and is configured to drive the rotating mechanism 2 to rotate an index angle each time when the cabinet door 12 rotates toward a set position from the closed position. In the present embodiment, the linkage mechanism 3 is arranged on the top end of the rotating mechanism 2.

The space in the top of the cabinet 1 is sufficient, so it is convenient in maintenance operation when the linkage mechanism 3 is arranged on the top end of the rotating mechanism 2.

In the present embodiment, the vending machine includes two linkage mechanisms 3. One of the linkage mechanisms 3 is connected between the rotating mechanism 2 in the first accommodating space and the cabinet door 12 of the first accommodating space, another of the linkage mechanisms 3 is connected between the rotating mechanism 2 in the second accommodating space and the cabinet door 12 of the second accommodating space.

Figure 9:
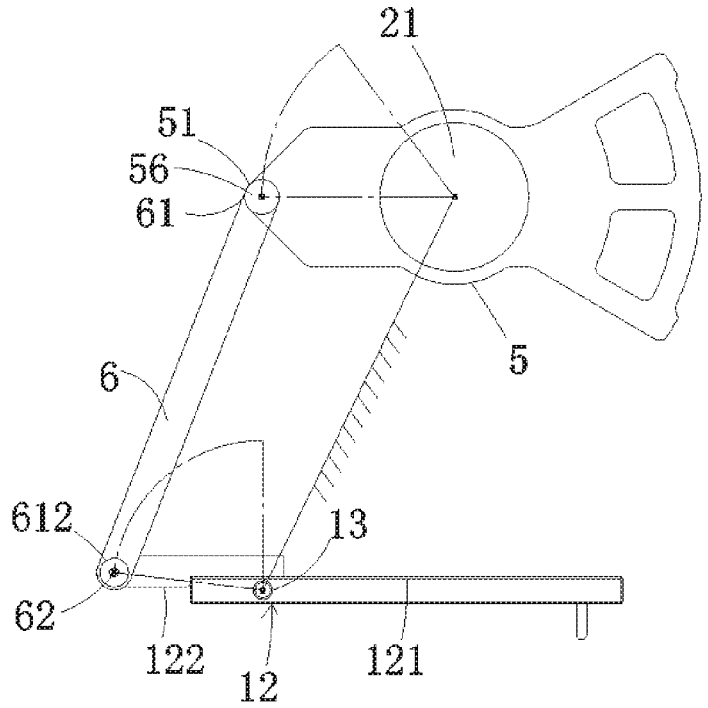
FIG. 9 is a partial structural schematic view of a linkage mechanism of the vending machine according to one embodiment.
Figure 10:
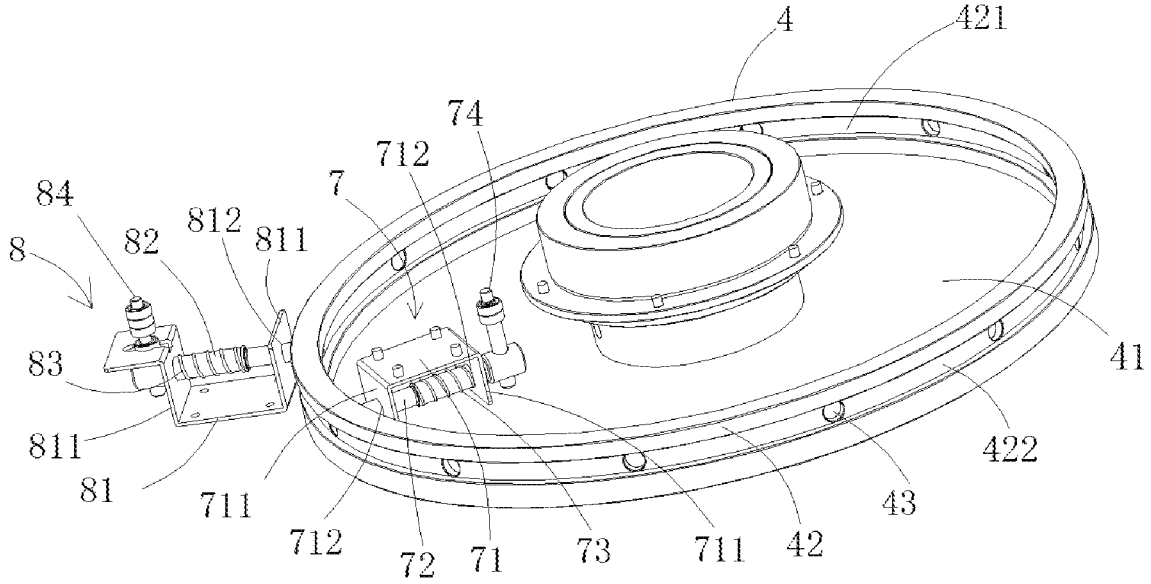
FIG. 10 is a partial structural schematic view of the vending machine according to another embodiment.

FIG. 9 is a partial structural schematic view of the linkage mechanism of the vending machine according to one embodiment. FIG. 10 is a partial structural schematic view of the vending machine according to another embodiment. As shown in FIG. 9 and FIG. 10, the linkage mechanism 3 includes a driving member 5, a connecting rod 6, a first locking mechanism 7, and a second locking mechanism 8. The driving member 5 is located on one side of the index plate 4 provided with the cylinder wall 42. The middle portion of the driving member 5 is fitly sleeved on the rotary shaft 21. The driving member 5 can freely rotate about the axis of the rotary shaft 21.

Optionally, the driving member 5 is spaced from the cylinder wall 42 of the index plate 4 along the axial direction of the rotary shaft 21, which can avoid a contact friction between the driving member 5 and the index plate 4 that occurs when the driving member 5 and the index plate 4 are relatively rotated. Thereby the rotational load of the driving member 5 is reduced.

A first end 61 of connecting rod 6 is pivotally connected with a first end 51 of driving member 5 via a first pivot 56. A second end 62 of connecting rod 6 is pivotally connected with the cabinet door 12 via a second pivot 612. The cabinet door 12 includes a door body 121 and a connecting board 122. The door body 121 and the connecting board 122 are fixedly connected. A crank and rocker mechanism is formed between the pivoting shaft 13, the rotary shaft 21, the first pivot 56 and the second pivot 612, in which a crank is formed between the pivoting shaft 13 and the second pivot 612 and a rocker is formed between the rotary shaft 21 and the first pivot 56. According to the characteristics of the crank and rocker mechanism, when the crank rotates the rocker is driven by the crank to reciprocating swing by a set angle which is greater than one index angle and less than two index angles.

In the present embodiment, when the cabinet door 12 moves to the opened position from the closed position, the cabinet door 12 rotates about 90 degrees about the pivoting shaft 13 (namely, the crank rotates about 90 degrees), the drive member 5 swings the set angle about the axis of the rotary shaft 21 via the connecting rod 6. The set angle is greater than 30 degrees and less than 60 degrees, that is, the maximum angle that the rocker swings is greater than 30 degrees and less than 60 degrees.

In other embodiments, when the door cabinet 12 rotates toward the closed position from the opened position, the rotating mechanism 2 is driven to rotate via the linkage mechanism 3.

The first locking mechanism 7 is arranged on the driving member 5, and configured to lock or release the connection between the driving member 5 and the index plate 4. When the first locking mechanism 7 locks the connection between the driving member 5 and the index plate 4, the first locking mechanism 7 is in a locked state. When the first locking mechanism 7 releases the connection between the driving member 5 and the index plate 4, the first locking mechanism 7 is in a released state.

Optionally, when the connection between the driving member 5 and the index plate 4 is locked, the driving member 5 and the index plate 4 are not rotatable relative to each other. The rotation of the driving member 5 about the axis of the rotary shaft 21 drives the index plate 4 to synchronously rotate therewith, that is, at this moment the rotating mechanism 2 synchronously rotates with the driving member 5. When the connection between the driving member 5 and the index plate 4 is released, the driving member 5 and the index plate 4 are rotatable relative to each other. The rotation of the driving member 5 cannot drive the index plate 4 to rotate therewith, that is, at this moment the driving member 5 and the rotating mechanism 2 are independent from each other.

Figure 11:
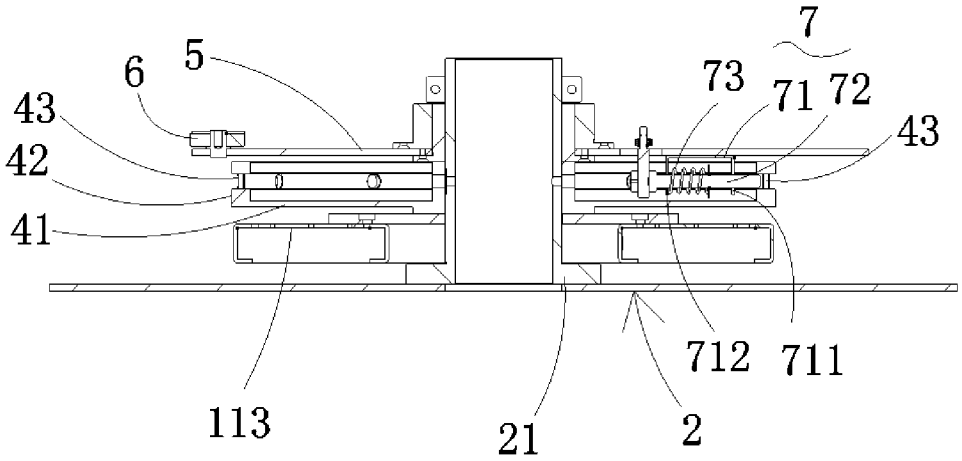
FIG. 11 is a structural sectional view of a first locking mechanism of the vending machine according to one embodiment.

FIG. 11 is a structural sectional view of the first locking mechanism of the vending machine according to one embodiment. As shown in FIG. 10 and FIG. 11, the first locking mechanism 7 includes a first bracket 71, a first pin 72 and a first elastic member 73. The first bracket 71 is located inside the cylinder wall 42, and fixedly connected with the driving member 5. The first bracket 71 includes two first supporting boards 711 arranged at intervals and in parallel, and two first supporting holes 712 coaxially arranged on the two first supporting boards 711. An axis of the two first supporting holes 712 is perpendicularly intersected with the axis of the rotary shaft 21. Along the axial direction of the rotary shaft 21, the axis of the two first supporting holes 712 and the axes of the plurality of index holes 43 on the cylinder wall 42 are on a same plane. The first pin 72 is supported by the two first supporting holes 712, and moveable along the axial direction of the first pin 72 to be close to or away from the cylinder wall 42. One end of the first elastic member 73 is connected with the first pin 72, and another end of the first elastic member 73 is connected with the first bracket 71. Under the action of the first elastic member 73, the first pin 72 always has a tendency to insert into the index hole 43. When the first pin 72 faces to any one of the index holes 43 on the cylinder wall 42, the first pin 72 is fitly inserted into the any one of the index holes 43. At this moment, the first pin 72 is in a locked position, and the first locking mechanism 7 locks the connection between the driving member 5 and the index plate 4. When the driving member 5 rotates about the axis of the rotary shaft 21, the driving member 5 drives the index plate 4 to synchronously rotate therewith via the first pin 72. Therefore, the rotation of the driving member 5 can drive the rotating mechanism 2 to rotate therewith. When the first pin 72 does not face to any one of the index holes 43, the first pin 72 is abutted against the inner wall of the cylinder wall 42. At this moment, the first pin 72 is in a released position, the first locking mechanism 7 releases the connection between the driving member 5 and the index plate 4, the driving member 5 and the rotating mechanism 2 are independent from each other and rotatable relative to each other, and the rotation of the driving member 5 cannot drive the rotating mechanism 2 to rotate.

In the present embodiment, the cylinder wall 42 is provided with the inner annual groove 421. The diameter of the first pin 72 is fitted with the diameter of the each of the index holes 43, and the diameter of each of the index holes 43 is fitted with the groove width of the inner annual groove 421. Under the action of the first elastic member 73, the first pin 72 is inserted into the inner annular groove 421. When the driving member 5 and the index plate 4 are relatively rotated, the inner annular groove 421 guides the first pin 72 to move, so that when the first pin 72 faces to any one of the index holes 43, the first pin 72 can be smoothly inserted into the any one of the index holes 43.

The second locking mechanism 8 is arranged between the cabinet body 11 and the index plate 4, and is configured to lock or release the connection between the index plate 4 and the cabinet body 11. When the second locking mechanism 8 locks the connection between the cabinet body 11 and the index plate 4, the second locking mechanism 8 is in a locked state. When the second locking mechanism 8 releases the connection between the cabinet body 11 and the index plate 4, the second locking mechanism 8 is in a released state.

Optionally, when the second locking mechanism 8 locks the connection between the index plate 4 and the cabinet body 11, the index plate 4 is fixed relative to the cabinet body 11, and cannot rotate about the axis of the rotary shaft 21; namely, the rotating mechanism 2 is fixed relative to the cabinet body 11. When the second locking mechanism 8 releases the connection between the index plate 4 and the cabinet body 11, the index plate 4 is freely rotatable about the axis of the rotary shaft 21; namely, the rotating mechanism 2 and the cabinet body 11 are independent from each other.

Figure 12:
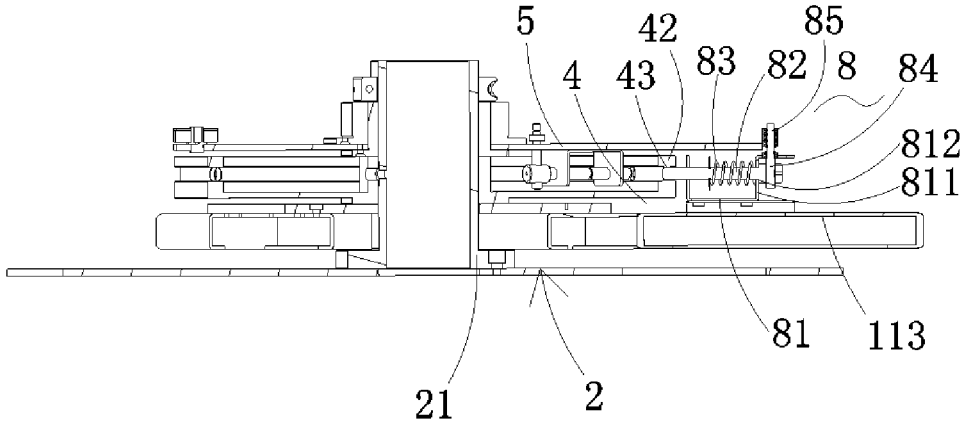
FIG. 12 is a structural sectional view of a second locking mechanism of the vending machine according to one embodiment.

FIG. 12 is a structural sectional view of the second locking mechanism of the vending machine according to one embodiment. As shown in FIG. 12, the second locking mechanism 8 includes a second bracket 81, a second pin 82, a second elastic member 83 and a second pillar 84. The second bracket 81 is fixedly connected to the top wall 113 of the cabinet body 11, and is located outside the cylinder wall 42. The second bracket 81 includes two second supporting boards 811 arranged at intervals and in parallel, and two second supporting holes 812 coaxially arranged on the two second supporting boards 811. An axis of the two second supporting holes 812 is perpendicularly intersected with the axis of the rotary shaft 21. Along the axial direction of the rotary shaft 21, the axes of the two second supporting holes 812 and the axes of the plurality of index holes 43 are on a same plane. The second pin 82 is supported by the two second supporting holes 812, and is moveable along an axial direction of the second pin 82 to be close to or away from the cylinder wall 42. One end of the second elastic member 83 is connected to the second bracket 81, and another end of the second elastic member 83 is connected to the second pin 82. Under the action of the second elastic member 83, the second pin 82 always has a tendency to insert into the index hole 43. When the second pin 82 faces to any one of the index holes 43 on the cylinder wall 42, the second pin 82 is fitly inserted into the any one of the index holes 43. At this moment, the second pin 82 is in the locked position, the second locking mechanism 8 locks the connection between the index plate 4 and the cabinet body 11, so that the index plate 4 cannot rotate about the axis of the rotary shaft 21. When the second pin 82 does not face to any one the index holes 82, the second pin 82 is abutted against the outer wall of the cylinder wall 42. At this time, the second pin 82 is in the released position, the second locking mechanism 8 releases the connection between the index plate 4 and the cabinet body 11, so that the index plate 4 is freely rotatable about the axis of the rotary shaft 21. The second pillar 84 is fixedly connected with the second pin 82, and located in the rotational path of the second end 52 of driving member 5. When the driving member 5 rotates about the axis of the rotary shaft 21, the second end 52 of driving member 5 is directly or indirectly abutted against the second pillar 84, and drives the second pillar 84 to drive the second pin 82 to move towards the released position against the elastic force of the second elastic member 83. Optionally, the axis of the second pillar 84 is perpendicularly intersected with the axis of the second pin 82.

Optionally, the second locking mechanism 8 further includes a roller 85. The roller 85 is fitly sleeved on the second pillar 84, and is freely rotatable about the second pillar 84. When the driving member 5 rotates about the axis of the rotary shaft 21, the second end 52 of driving member 5 is abutted against the roller 85, and drives the roller 85 to drive the second pin 82 to move towards the released position via the second pillar 84. Since the roller 85 is rotatable about the second pillar 84, it reduces the frictional resistance that occurs when the driving member 5 drives the second pin 82 to move.

In the present embodiment, the cylinder wall 42 is provided with the outer annular groove 422. The diameter of the second pin 82 is fitted with the diameter of the each of the index holes 43, the diameter of each of the index holes 43 is fitted with the groove width of the outer annular groove 422. Under the action of the second elastic member 83, the second pin 82 is inserted into the outer annular groove 422 of the cylinder wall 42. When the index plate 4 rotates about the axis of the rotary shaft 21, the outer annular groove 422 guides the second pin 82 to face to one of the index holes 43 in the outer annular groove 422, so that when the second pin 82 faces to any one of the index holes 43 of the index plate 4, the second pin 82 can be smoothly inserted into the any one of the index holes 43.

The above first locking mechanism and the second locking mechanism are optional embodiments. In other embodiments, at least one of the first locking mechanism and the second locking mechanism may adopt an electric pin type locking mechanism, in which the pin is attracted by the magnetic force of the electromagnet, and in which the magnetic force is controlled by the on-off of the power to control the pin to be inserted into or detached from the index plate.

The following is a description of the working process of the vending machine provided by the present embodiment with reference to the FIG. 13 to FIG. 16.

Figure 13:
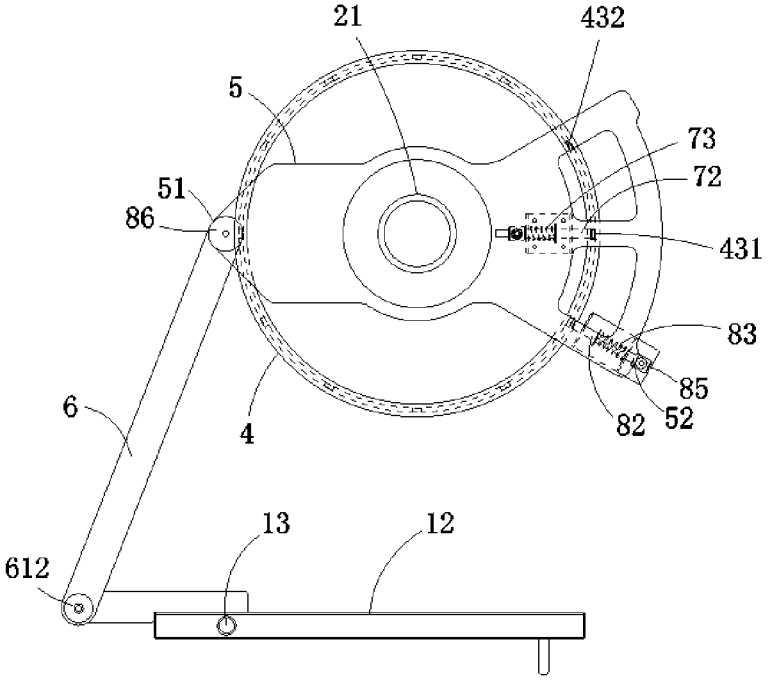
FIG. 13 is a schematic view of the linkage mechanism of vending machine when the cabinet door is closed.

FIG. 13 is a schematic view of the linkage mechanism of vending machine when the cabinet door is closed. For convenience of description, the adjacent two of the index holes 43 along the opening direction of the cabinet door 12 are sequentially referred to as a first index hole 431 and a second index hole 432. When the cabinet door 12 is in a closed position, the first pin 72 of the first locking mechanism 7 is inserted into the first index hole 431, and the second end 52 of driving member 5 is abutted against the roller 85 of the second locking mechanism 8, and drives the second pin 82 to move to the released position, namely, the first locking mechanism 7 locks the connection between the driving member 5 and the index plate 4, and the second locking mechanism 8 releases the connection between the index plate 4 and the cabinet 1.

Figure 14:
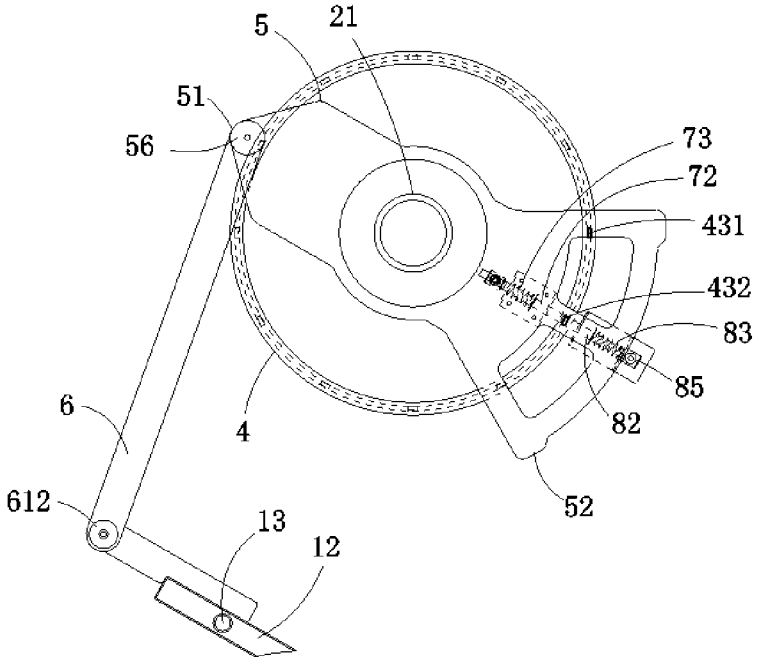
FIG. 14 is a schematic view of the linkage mechanism of the vending machine when the cabinet door is opened by one index angle according to one embodiment.

FIG. 14 is a schematic view of the linkage mechanism of the vending machine when the cabinet door is rotated by one index angle. As shown in FIG. 14, when the cabinet door 12 is rotated towards the set position from the closed position (namely, the cabinet door 12 is rotated by one index angle from the closed position), the first pin 72 is inserted into the first index hole 431. Therefore, the cabinet door 12 drives the driving member 5 to rotate about the axis of the rotary shaft 21 via the connecting rod 6, and the driving member 5 drives the index plate 4 to rotate. When the cabinet door 12 is rotated by 30 degrees, the commodity storage space at the set position of the rotating mechanism 2 faces to the opening of the cabinet body 11. At this time, the second pin 82 faces to the first index hole 431 on the index plate 4, and is inserted into the first index hole 431 under the action of the elastic force of the second elastic member 83, and pushes the first pin 72 out of the first index hole 431. At this time, the first locking mechanism 7 releases the connection between the driving member 5 and the rotating mechanism 2, while the second locking mechanism 8 locks the connection between the rotating mechanism 2 and the cabinet body 11, even if the cabinet door 12 is continued to rotate toward the opening direction, the index plate 4 will not rotate.

Figure 15:
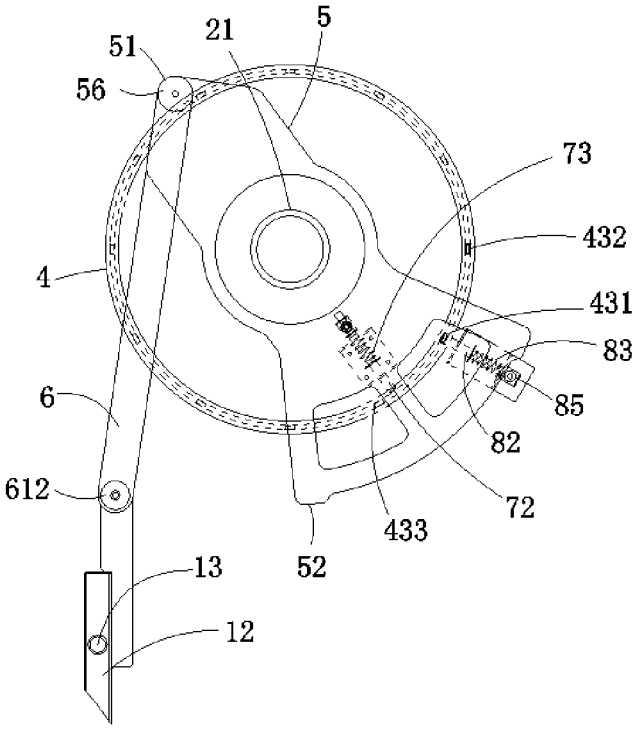
FIG. 15 is schematic view of the linkage mechanism of the vending machine when the cabinet door is opened by 90 degrees according to one embodiment.

FIG. 15 is a schematic view of the linkage mechanism of the vending machine when the cabinet door is opened by 90 degrees. As shown in FIG. 15, when the cabinet door 12 is rotated to the opened position from the position at 30 degrees, namely in the process of rotation by 90 degrees, limited by the crank rocker mechanism, the swing angle of the driving member 5 is less than 30 degrees. The first pin 72 will not be inserted into any one of the index holes 43, and the second pin 82 is inserted into the first index hole 431 all the way. That is, the first locking mechanism 7 releases the connection between the driving member 5 and the rotating mechanism 2, while the second locking mechanism 8 locks the connection between the rotating mechanism 2 and the cabinet body 11. Therefore, the rotating mechanism 2 is always stationary during this process. When the cabinet door 12 is opened by 90 degrees, the opening of the cabinet 11 is completely opened, and at this time, the commodity in the commodity storage space corresponding to the opening can be taken away.

Figure 16:
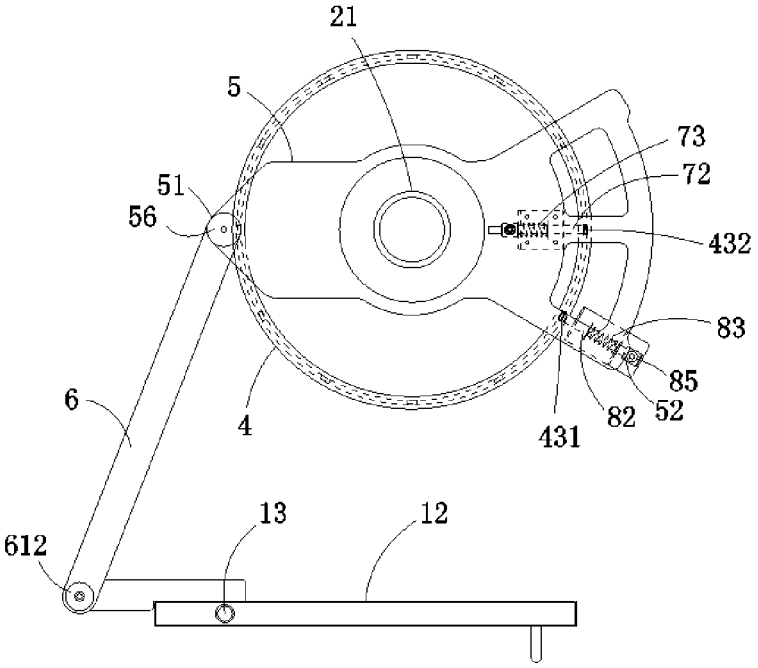
FIG. 16 is a schematic view of the linkage mechanism of the vending machine when the cabinet door is closed again according to one embodiment.

FIG. 16 is a schematic view of the linkage mechanism of the vending machine when the cabinet door is closed again. As shown in FIG. 16, when the commodity is taken away and the cabinet door 12 is closed, namely the cabinet door 12 is rotated toward the closed position from the opened position, and that the rotation angle of the driving member 5 is less than 30 degrees is determined by the snapback characteristic of the crank rocker mechanism. When the cabinet door 12 is completely closed, the second end 52 of driving member 5 is in contact with the roller 85 of the second locking mechanism 8 and drives the second pin 82 to move to the released position, and the second locking mechanism 8 releases the connection between the rotating mechanism 2 and the cabinet body 11. At the same time, the first pin 72 faces to the second index hole 432, and is fitly inserted into the second index hole 432 under the action of the first elastic member 73. The first pin 72 is in the locked position, locks the connection between the driving member 5 and the rotating mechanism 2 again, and waits for the next opening operation.

The vending machine provided by the present embodiment includes the cabinet, the rotating mechanism arranged inside the cabinet, and the linkage mechanism connected between the rotating mechanism and the cabinet door of the cabinet. The rotating mechanism includes the rotary shaft, the rotating plate body sleeved on the rotary shaft, and the index plate sleeved on the rotary shaft. The linkage mechanism includes the driving member, the first locking mechanism configured to lock or release the connection between the driving member and the rotating mechanism, and the second locking mechanism configured to lock or release the connection between the rotating mechanism and the cabinet body. When the cabinet door is rotated toward the set position from the closed position, the first locking mechanism locks the connection between the driving member and the rotating mechanism, while the second locking mechanism releases the connection between the rotating mechanism and the cabinet. The rotation of the cabinet door drives the driving member and the rotating mechanism to rotate one index angle, so that the commodity storage space at the set position of the rotating mechanism faces to the opening of the cabinet. At this time, the first locking mechanism releases the connection between the driving member and the rotating mechanism, while the second locking mechanism locks the connection between the rotating mechanism and the cabinet, so that the rotating mechanism is fixed relative to the cabinet. When the cabinet door is continued to rotate toward the opened position along the opening direction, the rotating mechanism does not synchronously rotate with the cabinet door.

The vending machine provided by the present embodiment realizes the rotation of the rotating mechanism by the manual operation of opening the cabinet door, which greatly saves the manufacturing cost of the machine compared with the related art in which the motor drives the turntable to rotate.

Figure 17:
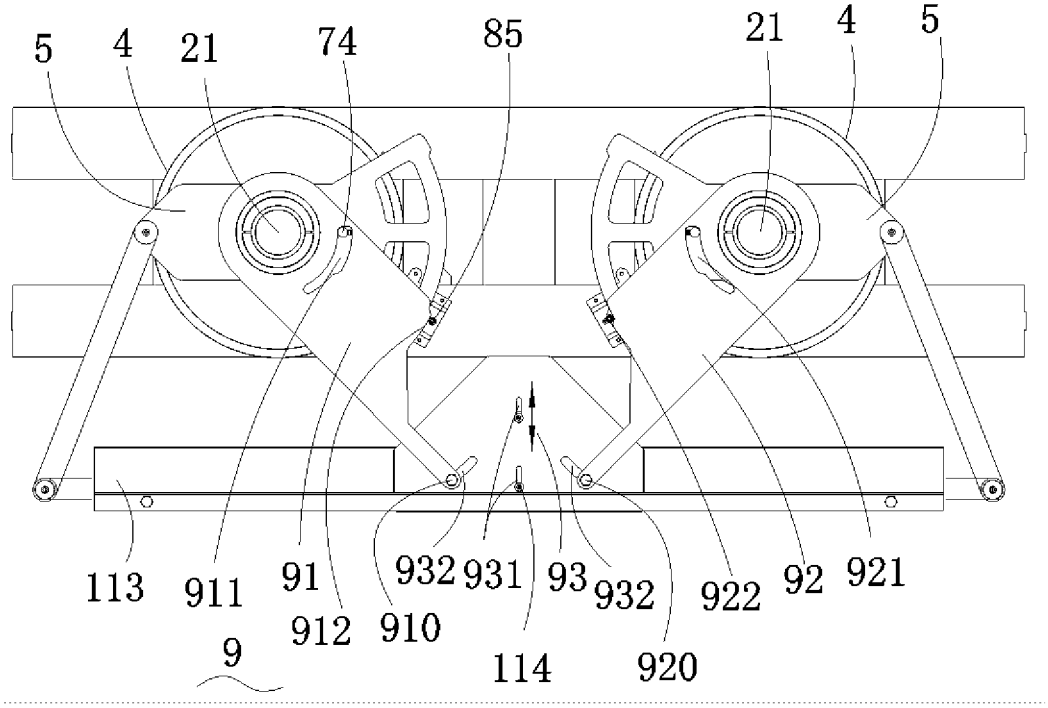
FIG. 17 is a partial structural view of the vending machine according to another embodiment.

FIG. 17 is a partial structural view of the vending machine according to another embodiment. As shown in FIG. 17, the present embodiment differs from the previous embodiment in that the vending machine of the present embodiment further includes an emergency mechanism 9. The emergency mechanism 9 includes a first wrench 91. The first wrench 91 is fitly sleeved on the rotary shaft 21 of the rotating mechanism 2, and rotatable about the rotary shaft 21. Accordingly, the first locking mechanism 7 further includes a first pillar 74. The first pillar 74 is perpendicularly and fixedly connected with the first pin 72, penetrates the driving member 5, and protrudes from the upper surface of the driving member 5. The first wrench 91 includes a driving groove 911 and a driving portion 912. The driving groove 911 is fitly sleeved on the first pillar 74. When the first wrench 91 is rotated along the set direction, the driving groove 911 drives the first pillar 74 to drive the first pin 72 to move to the released position. At the same time, the driving portion 912 is in contact with the roller 85 of the second locking mechanism 8, and drives the roller 85 to drive the second pin 82 to move to the released position. Therefore, by rotating the first wrench 91, the connection between the driving member 4 and the rotating mechanism 2 can be released, and the connection between the rotating mechanism 2 and the cabinet 11 can be released. At this time, the rotating mechanism 2 is freely rotatable about the rotary shaft 21.

The driving groove includes a base side, a first side and a second side, which are sequentially arranged from inside to outside along the radial direction of the rotary shaft. The first side and the second side are arranged oppositely to the base side. A first groove is formed between the first side and the base side, a second groove is formed between the second side and the base side. When the first pillar moves to the second groove from the first groove, the first pin is, from far to near, closed to the index plate, and inserted to the index hole. When the first pillar moves to the first groove from the second groove, the first pin is, from near to far, away from the index plate, and detached from the index hole.

In the present embodiment, the vending machine includes two rotating mechanisms 2. The emergency mechanism further includes a second wrench 92 and a connecting member 93. The structural form and the working principle of the second wrench 92 are the same as that of the first wrench 91. The first wrench 91 is fitly sleeved on the rotary shaft 21 of the rotating mechanism 2 in the first accommodating space. The second wrench 92 is fitly sleeved on the rotary shaft 21 of the rotating mechanism 2 in the second accommodating space. The connecting member 93 is connected with the first wrench 91 and the second wrench 92 at the same time. The connecting member 93 may be operated to simultaneously drive the first wrench 91 to rotate along a set direction and the second wrench 92 to rotate along a direction opposite to the set direction, so that the first wrench 91 releases the positional locking of rotating mechanism 2 in the first accommodating space and the second wrench 92 releases the positional locking of the rotating mechanism 2 in the second accommodating space. Therefore the connecting member 93 can simultaneously release the positional locking of two rotating mechanisms 2 by one operation, which is convenient for maintenance.

Optionally, the connecting member 93 includes two long grooves 931 and two guiding groove 932. The connecting member 93 is fitly sleeved on two rivets 114 on the top wall 113 of the cabinet through the two long grooves 931 respectively, so that the connecting member 93 can only move along the longitudinal direction of the long groove 931. Each of the two guiding grooves 932 is a segment of circular arc groove with a center of their respective rotary shafts 21. The first wrench 91 is fitly inserted into one of the guiding grooves 932 through a first shaft 910, and the second wrench 92 is fitly inserted into another of the guiding grooves 932 through a second shaft 920. When the connecting member 93 moves along the longitudinal direction of the long grooves 931, the two guiding grooves 932 respectively drive the first wrench 91 and the second wrench 92 to rotate, the first wrench 91 releases the locking of the rotating mechanism 2 with the linkage mechanism 3 in the first accommodating space, so that the rotating mechanism 2 in the first accommodating space is freely rotatable about the rotary shaft 21 thereof, while the second wrench 92 releases the locking of the rotating mechanism 2 with the linkage mechanism 3 in the second accommodating space, so that the rotating mechanism 2 is freely rotatable about the rotary shaft 21 thereof.

The vending machine provided by the present embodiment includes the emergency mechanism. Once the linkage mechanism fails to work, the connection between the driving member and the rotating mechanism and the connection between the rotating mechanism and the cabinet are released by the emergency mechanism, so that the rotating mechanism is freely rotatable about the axis thereof. Therefore, in the present embodiment, the maintainability of the machine is improved by the arrangement of the emergency mechanism.

INDUSTRIAL APPLICABILITY

Compared with the related art in which the motor drives the rotating mechanism to rotate, the vending machine provided by the present disclosure greatly saves manufacturing cost of the machine.

What is claimed is:

1. A vending machine, comprising a cabinet, a rotating mechanism, and a linkage mechanism, wherein:

the cabinet comprises a cabinet body and a cabinet door pivotally connected to the cabinet body, an accommodating space is arranged in the cabinet body, an opening communicated with the accommodating space is arranged on the cabinet body, and the cabinet door is capable of opening or closing the opening;

the rotating mechanism is arranged in the cabinet body, and is rotatable relative to the cabinet body, the cabinet door is configured to drive the rotating mechanism to rotate via the linkage mechanism when the cabinet door is rotated toward a set position from a closed position;

the linkage mechanism comprises a driving member and a first locking mechanism, the driving member is connected with the cabinet door in a transmission manner, the first locking mechanism is arranged on the driving member and has a locked state and a released state, the rotating mechanism is configured to synchronously rotate with the driving member when the first locking mechanism is in the locked state, and the driving member is unable to drive the rotating mechanism to rotate when the first locking mechanism is in the released state.

2. The vending machine according to claim 1, wherein:

when the cabinet door is rotated toward the set position from the closed position, the first locking mechanism is in the locked state, and the driving member is configured to drive, by rotating the cabinet door, the rotating mechanism to rotate along a first direction;

when the cabinet door is rotated toward the closed position from the set position, the first locking mechanism is in the released state, and the driving member is configured to rotate, driven by the cabinet door, relative to the rotating mechanism along a second direction;

the second direction is opposite to the first direction.

3. The vending machine according to claim 1, wherein:

the driving member is fitly sleeved on a rotary shaft of the rotating mechanism;

the linkage mechanism further comprises a connecting rod; a first end of connecting rod is pivotally connected to the cabinet door, a second end of the connecting rod is pivotally connected to the driving member;

a linking mechanism is formed between the cabinet door, the connecting rod, the driving member and the rotary shaft.

4. The vending machine according to claim 3, wherein:

the linking mechanism is a crank and rocker mechanism;

the cabinet door is pivotally connected to the cabinet body via a pivoting shaft; the connecting rod is pivotally connected to the driving member via a first pivot, and pivotally connected to the cabinet door via a second pivot;

a crank is formed between the pivoting shaft and the second pivot, a rocker is formed between the rotary shaft and the first pivot.

5. The vending machine according to claim 1, wherein:

the rotating mechanism comprises a rotary shaft, a rotating plate body and an index plate; the rotating plate body and the index plate are fixedly sleeved on the rotary shaft in sequence; a plurality of index holes are distributed at intervals on the index plate along a circumferential direction of the rotary shaft;

the first locking mechanism comprises a first pin movably connected with the driving member and capable of being inserted into any one of the index holes, and a first elastic member connected between the driving member and the first pin;

under an action of the first elastic member, the first pin always has a tendency to be inserted into the index hole;

when the cabinet door is rotated toward the set position from the closed position, the first pin is inserted into the index hole, and the first locking mechanism is in the locked state;

when the cabinet door is rotated toward the closed position from the set position, the first pin is detached from the index hole, and the first locking mechanism is in the released state.

6. The vending machine according to claim 5, wherein:

the index plate comprises a bottom plate and a cylinder wall;

the bottom plate is sleeved on the rotary shaft, the cylinder wall is arranged along a circumference of the bottom plate, an inner annular groove is arranged on an inner side of the cylinder wall, and the index holes are located in the inner annular groove and penetrate through the cylinder wall;

the first pin is configured to move along the inner annular groove when the cabinet door is rotated toward the closed position from the set position.

7. The vending machine according to claim 1, wherein:

the linkage mechanism further comprises a second locking mechanism arranged on the cabinet body and having a locked state and a released state;

the rotating mechanism is fixed relative to the cabinet body when the second locking mechanism is in the locked state;

the rotating mechanism is rotatable relative to the cabinet body when the second locking mechanism is in the released state.

8. The vending machine according to claim 7, wherein:

the rotating mechanism comprises a rotary shaft, a rotating plate body and an index plate; the rotating plate body and the index plate are fixedly sleeved on the rotary shaft in sequence; a plurality of index holes are distributed at intervals on the index plate along a circumferential direction of the rotary shaft;

the second locking mechanism comprises a second pin movably connected with the driving member and capable of being inserted into any one of the index holes, a second elastic member connected between the cabinet body and the second pin, and a second pillar connected with the second pin;

under an action of the second elastic member, the second pin always has a tendency to be inserted into the index hole; the driving member is provided with an abutment portion;

when the cabinet door is rotated toward the set position from the closed position, the abutment portion is directly or indirectly abutted against the second pillar to drive the second pin to be detached from the index hole, so that the second locking mechanism is in the released state.

9. The vending machine according to claim 8, wherein:

the first locking mechanism comprises a first pin movably connected with the driving member and capable of being inserted into any one of the index holes, and a first elastic member connected between the driving member and the first pin;

under the action of the first elastic member, the first pin always has a tendency to be inserted into the index hole;

when the cabinet door is rotated toward the set position from the closed position, the first pin is inserted into the index hole, and the first locking mechanism is in the locked state;

when the cabinet door arrives at the set position, the index hole into which the first pin is inserted faces to the second pin, the second pin is inserted into the index hole, and pushes the first pin out of the index hole;

when the cabinet door is rotated toward the closed position from the set position, the first pin is detached from the index hole, the second pin is inserted into the index hole, the first locking mechanism is in the released state, and the second locking mechanism is in the locked state.

10. The vending machine according to claim 9, further comprising an emergency mechanism, the emergency mechanism comprising a wrench pivotally connected to the rotary shaft, wherein:

when the wrench is driven to rotate about the rotary shaft along a set direction, the wrench causes the first locking mechanism and the second locking mechanism be simultaneously in the released state, so that the rotating mechanism, the driving member, and the cabinet body are relatively rotatable.

11. The vending machine according to claim 8, wherein:

the index plate comprises a bottom plate and a cylinder wall;

the bottom plate is sleeved on the rotary shaft, the cylinder wall is arranged along a circumference of the bottom plate, an outer annular groove is arranged on an outer side of the cylinder wall, the index holes are located in the outer annular groove and penetrate through the cylinder wall;

the second pin is configured to move along the outer annular groove when the cabinet door is rotated toward the set position from the closed position.

12. The vending machine according to claim 8, wherein:

the second locking mechanism further comprises a roller sleeved on the second pillar;

the abutment portion is abutted against the roller, when the cabinet door is rotated toward the set position from the closed position.

13. The vending machine according to claim 10, wherein:

the first locking mechanism further comprises a first pillar connected with the first pin; the wrench comprises a driving groove into which the first pillar is inserted, and a driving portion abutted against the second pillar;

when the wrench is driven to rotate about the rotary shaft along the set direction, the driving groove drives, via the first pillar, the first pin to be detached from the index hole, and the driving portion drives, via the second pillar, the second pin to be detached from the index hole, so that the first locking mechanism and the second locking mechanism are simultaneously in the released state.

14. The vending machine according to claim 13, wherein:

the driving groove comprises a base side, a first side and a second side which are sequentially arranged from inside to outside along a radial direction of the rotary shaft;

the first side and the second side are both arranged to be spaced from and be opposite to the base side, a first groove is formed between the first side and the base side, a second groove is formed between the second side and the base side;

the first pin is inserted into the index hole when the first pillar moves toward second groove from the first groove;

the first pin is detached from the index hole when the first pillar moves toward the first groove from the second groove.

15. The vending machine according to claim 10, wherein:

the emergency mechanism further comprises a connecting member connected with cabinet body and moveable relative to the cabinet body;

the rotating mechanism comprises a first rotating mechanism and a second rotating mechanism, the wrench comprises a first wrench and a second wrench, the first rotating mechanism is arranged to be corresponding to the first wrench, the second rotating mechanism is arranged to be corresponding to the second wrench; the connecting member is connected between the first wrench and the second wrench;

the connecting member comprises a first guiding groove and a second guiding groove; the driving portion of the first wrench is inserted into the first guiding groove, and the driving portion of the second wrench is inserted into the second guiding groove;

when the connecting member moves relative to the cabinet body, the connecting member drives, via the first guiding groove, the first wrench to rotate about the rotary shaft along a first set direction, and the connecting member drives, via the second guiding groove, the second wrench to rotate about the rotary shaft along a second set direction;

the set second direction is opposite to the first set direction.

* * * * *